US007757749B2

(12) United States Patent
Sakashita et al.

(10) Patent No.: US 7,757,749 B2
(45) Date of Patent: Jul. 20, 2010

(54) AIR CONDITIONER

(75) Inventors: Akihiko Sakashita, Sakai (JP); Tsunehisa Sanagi, Sakai (JP); Azumi Terakawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 100 days.

(21) Appl. No.: 12/212,726

(22) Filed: Sep. 18, 2008

(65) Prior Publication Data

US 2009/0013711 A1 Jan. 15, 2009

Related U.S. Application Data

(63) Continuation of application No. 10/553,234, filed on Oct. 14, 2005, now Pat. No. 7,497,246.

(30) Foreign Application Priority Data

Nov. 27, 2003 (JP) ..... 2003-396519
Nov. 18, 2004 (JP) ..... PCT/JP2004/017164

(51) Int. Cl.
*F24D 5/10* (2006.01)

(52) U.S. Cl. ..... 165/53; 454/233

(58) Field of Classification Search ..... 165/53; 62/259.2; 454/233
See application file for complete search history.

(56) References Cited

U.S. PATENT DOCUMENTS 6,250,373 B1 6/2001 Vecchi et al.
6,450,880 B1 9/2002 Asahina et al.
6,470,699 B1 10/2002 Okuda et al.
6,769,477 B2 * 8/2004 Hakkinen et al. ..... 165/53
7,000,688 B2 * 2/2006 Horttanainen et al. ..... 165/53

FOREIGN PATENT DOCUMENTS

| | | | |
|---|---|---|---|
| CN | 2430645 | Y | 5/2001 |
| EP | 1 319 900 | A1 | 6/2003 |
| JP | 04-64041 | | 6/1992 |
| JP | 07-92268 | B2 | 10/1995 |
| JP | 10-292945 | A | 11/1998 |
| JP | 11-2454 | A | 1/1999 |
| JP | 11-83060 | A | 3/1999 |
| JP | 11-211138 | A | 8/1999 |
| JP | 2000-283493 | A | 10/2000 |
| JP | 2001-201165 | A | 7/2001 |
| JP | 2001-336783 | A | 12/2001 |
| JP | 2003-214696 | A | 7/2003 |

* cited by examiner

*Primary Examiner*—Ljiljana (Lil) V Ciric
(74) *Attorney, Agent, or Firm*—Global IP Counselors

(57) ABSTRACT

An air conditioner principally includes a casing having a casing lower part formed by an alternating sequence of four panel side parts and four corner parts. The casing further has main outlets disposed along each of the panel side parts, and auxiliary outlets disposed at the corner parts. The air conditioner further includes horizontal flaps rotatably supported about longitudinal axes of the main outlets. A circumferential edge part of each of the auxiliary outlets is formed so that the air from each of the auxiliary outlets is blown out in a fixed direction.

18 Claims, 9 Drawing Sheets

AIR CONDITIONER

CROSS-REFERENCE TO RELATED APPLICATIONS

This application is a continuation application of U.S. patent application Ser. No. 10/553,234, filed on Oct. 14, 2005, which is a national phase application of International Application No. PCT/JP04/17164, filed on Nov. 18, 2004, which claims priority to Japanese Application No. 2003-396519, filed in Japan on Nov. 27, 2003. The entire disclosure of U.S. patent application Ser. No. 10/553,234 is hereby incorporated herein by reference.

BACKGROUND OF THE INVENTION

1. Field of the Invention

The present invention relates to an air conditioner, and more particularly relates to an air conditioner provided in the ceiling of an air conditioned room.

2. Related Art

A conventional air conditioner provided in the ceiling of an air conditioned room principally comprises: a casing having a casing lower part formed by an alternating sequence of four side parts and four corner parts; outlets disposed so that each runs along a side part and an inlet disposed so that it is surrounded by all the side parts; a fan and a heat exchanger disposed inside the casing; and horizontal flaps each oscillatably provided around the axis of each outlet in the longitudinal direction and capable of varying the wind direction of the air current blown out from each outlet. A motor, link mechanisms, and the like, for oscillating these horizontal flaps, are disposed at the corner parts of a face panel that constitutes the casing lower part in, for example, a ceiling embedded type air conditioner (e.g., refer to Japanese Publication No. H7-92268). With such an air conditioner, driving the fan sucks the air inside the air conditioned room through the inlets into the casing, and the air sucked into the casing is heated or cooled by the heat exchanger and then blown out in four directions through the outlets.

Incidentally, to regulate the temperature inside the air conditioned room at a prescribed temperature, it is preferable to increase the flow volume of the air blown out from the air conditioner as much as possible. However, if the flow volume of the air blown out from each of the outlets is increased, then the flow speed of the air blown out from each of the outlets increases, which unfortunately generates a draft, making it impossible to achieve a satisfactory air current distribution inside the air conditioned room.

Therefore, an air conditioner has been proposed that provides an arcuate outlet that surrounds the inlet, and blows out air radially through this outlet (e.g., refer to Japanese Publication No. 2001-201165). With this air conditioner, forming the outlet arcuately enables the enlargement of the opening area of the outlet, consequently enabling the flow volume of the air blown out from the outlet to be increased while suppressing an increase in the flow speed of the air blown out from the outlet.

However, with this air conditioner, because the shape of the outlet is arcuate, the horizontal flap must be made so that it can be slid vertically when the horizontal flap is oscillated, and a slide mechanism is consequently further provided in order to slide this horizontal flap. This slide mechanism principally comprises: an oscillating link integrally formed with the horizontal flap; a lever whose one end is coupled by a pin to the oscillating link and whose other end is linked to the rotary shaft of the motor; a spring that connects the lever and the casing; a slide shaft integrally formed with the horizontal flap; and a guiding groove that guides the slide shaft vertically. Further, the slide shaft is guided vertically along the guiding groove and the horizontal flap is slid vertically by the drive of the motor and the elasticity of the spring, thus enabling the wind direction of the air current blown out from the outlet to be varied.

Thus, with such an air conditioner, the blowing of the air out from the arcuate outlet increases the flow volume of the air and enables the satisfactory air current distribution inside the air conditioned room; however, it requires the provision of the slide mechanism, which consequently complicates the constitution in order to vary the wind direction of the air current blown out from the outlet, and increases the cost.

SUMMARY OF THE INVENTION

It is an object of the present invention, in an air conditioner provided in the ceiling of an air conditioned room, to make the air current distribution inside the air conditioned room satisfactory, and to simplify the structure needed to regulate the wind direction of the air current blown out from each of the outlets The air conditioner according to a first aspect of the present invention is an air conditioner provided in the ceiling of an air conditioned room, comprising a casing and horizontal flaps. The casing comprises: a casing lower part formed by an alternating sequence of four side parts and four corner parts; main outlets disposed so that they run along each of the side parts; an inlet disposed so that it is surrounded by all the side parts; and auxiliary outlets disposed at at least one of the four corner parts. The horizontal flaps are oscillatably provided about the axes of the main outlets in the longitudinal direction, and capable of varying the wind direction of an air current blown out from each of the main outlets. The circumferential edge part of each of the auxiliary outlets is formed so that air is blown out from each of the auxiliary outlets in a fixed direction.

With this air conditioner, the air sucked from the inlet into the casing is blown out into the air conditioned room through the four main outlets and the auxiliary outlets disposed at at least one of the four corner parts. Here, the air blown out from each of the auxiliary outlets is dragged by the air current blown out from each of the adjacent main outlets, and its wind direction tends to change. Consequently, by the oscillation of the horizontal flaps provided at the main outlets adjacent to these auxiliary outlets, the air blown out from each of the auxiliary outlets is changed so that it faces a direction the same as the wind direction of the air current blown out from each of the main outlets into the air conditioned room. By taking advantage of this characteristic, the wind direction of the air blown out from each of the auxiliary outlets can be varied, even if blown out in a fixed direction, without providing at each of the auxiliary outlets a mechanism, such as a horizontal flap, for varying the wind direction in the vertical direction of the air blown out from each of the auxiliary outlets.

Thus, with this air conditioner, the flow volume of the air is increased by the provision of the auxiliary outlets, the air current distribution inside the air conditioned room can be made satisfactory, and the constitution for regulating the blow-out direction can be simplified.

The air conditioner according to a second aspect of the present invention is an air conditioner as recited in the first aspect of the present invention, wherein the opening area of each of the auxiliary outlets is less than that of each of the main outlets.

With this air conditioner, because the flow speed of the air blown out from each of the main outlets does not decrease significantly, the air current distribution inside the air conditioned room can be made satisfactory by the provision of the auxiliary outlets, and the air blown out from each of the main outlets can reach as far as possible.

The air conditioner according to a third aspect of the present invention is an air conditioner as recited in the first or second aspect of the present invention, wherein the vertical blow-out direction of the air blown out from each of the auxiliary outlets is the direction of substantially the middle of the range by which each of the horizontal flaps vertically regulate the wind direction of the air current blown out from each of the main outlets.

With this air conditioner, the air blown out from each of the auxiliary outlets is blown out in a direction close to the blow-out direction of the air current blown out from each of the main outlets, which makes it easily affected by the air current blown out from each of the main outlets; consequently, it is dragged by the air current blown out from each of the main outlets, tracking characteristics are improved when varying the wind direction of the air current blown out from each of the auxiliary outlets, and the air current distribution inside the air conditioned room can be further satisfactorily maintained.

The air conditioner according to a fourth aspect of the present invention is an air conditioner as recited in any one of the first through third aspects of the present invention, wherein link mechanisms for mutually and synchronously oscillating two adjoining horizontal flaps are provided at the corner parts among the four corner parts provided with the auxiliary outlets. Each of the link mechanisms is disposed on the inlet side of each of the auxiliary outlets.

With this air conditioner, disposing the link mechanisms on the inlet side of the auxiliary outlets enables both the auxiliary outlets and the link mechanisms to be provided at the corner parts, without modifying the plan shape of the casing.

The air conditioner according to a fifth aspect of the present invention is an air conditioner as recited in the fourth aspect of the present invention, wherein each of the two horizontal flaps has linking pins provided at a position on the inner side in the longitudinal direction of the end part in the longitudinal direction of the horizontal flaps, axially supported by the casing lower part, and linked to the link mechanisms.

With this air conditioner, each horizontal flap can be linked to a link mechanism at a position on the inner side in the longitudinal direction of the end part thereof in the longitudinal direction; consequently, the link mechanism can be disposed further on the inlet side of the auxiliary outlet, and the auxiliary outlets can therefore be formed easily at the corner parts.

DETAILED DESCRIPTION OF THE PREFERRED EMBODIMENTS

The following explains the embodiments of an air conditioner according to the present invention, referencing the drawings.

(1) Basic Constitution of the Air Conditioner

Figure 1:
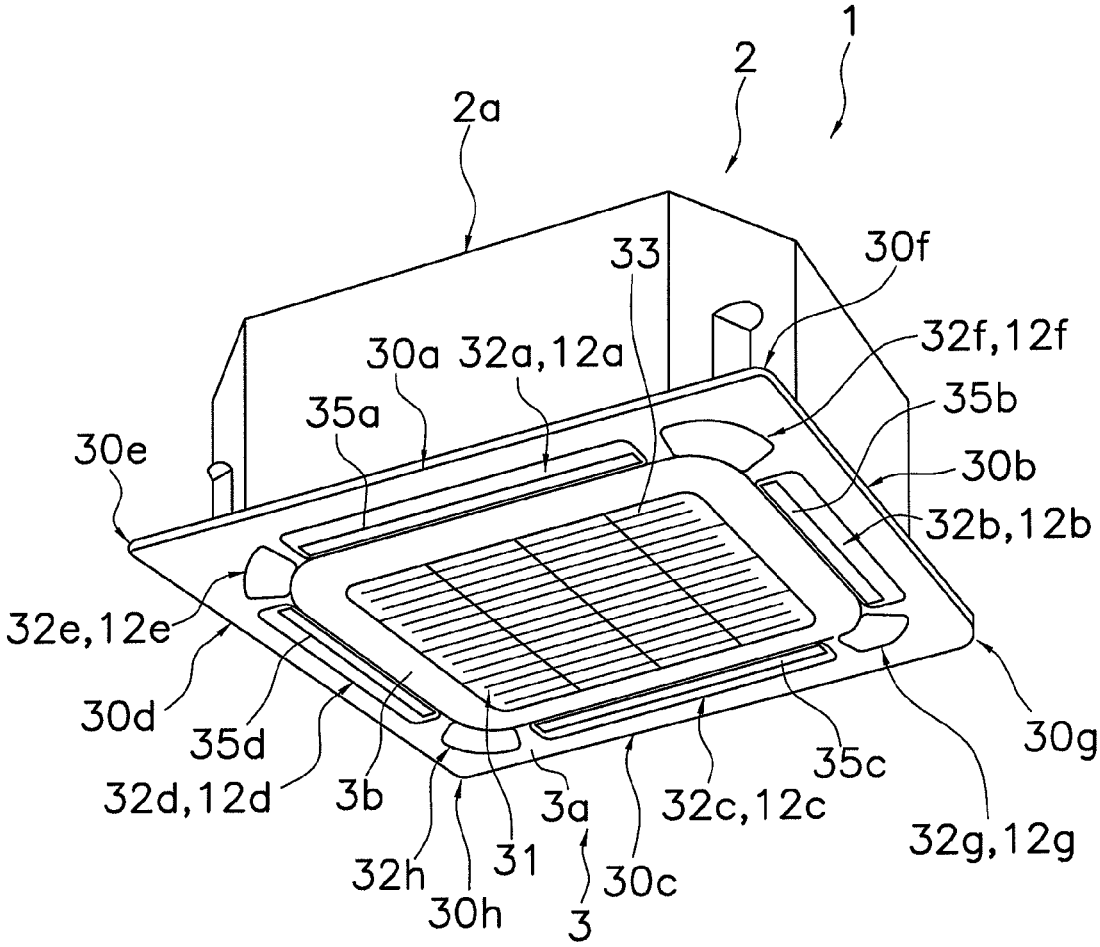
FIG. 1 is an external perspective view of an air conditioner according to one embodiment of the present invention.
Figure 2:
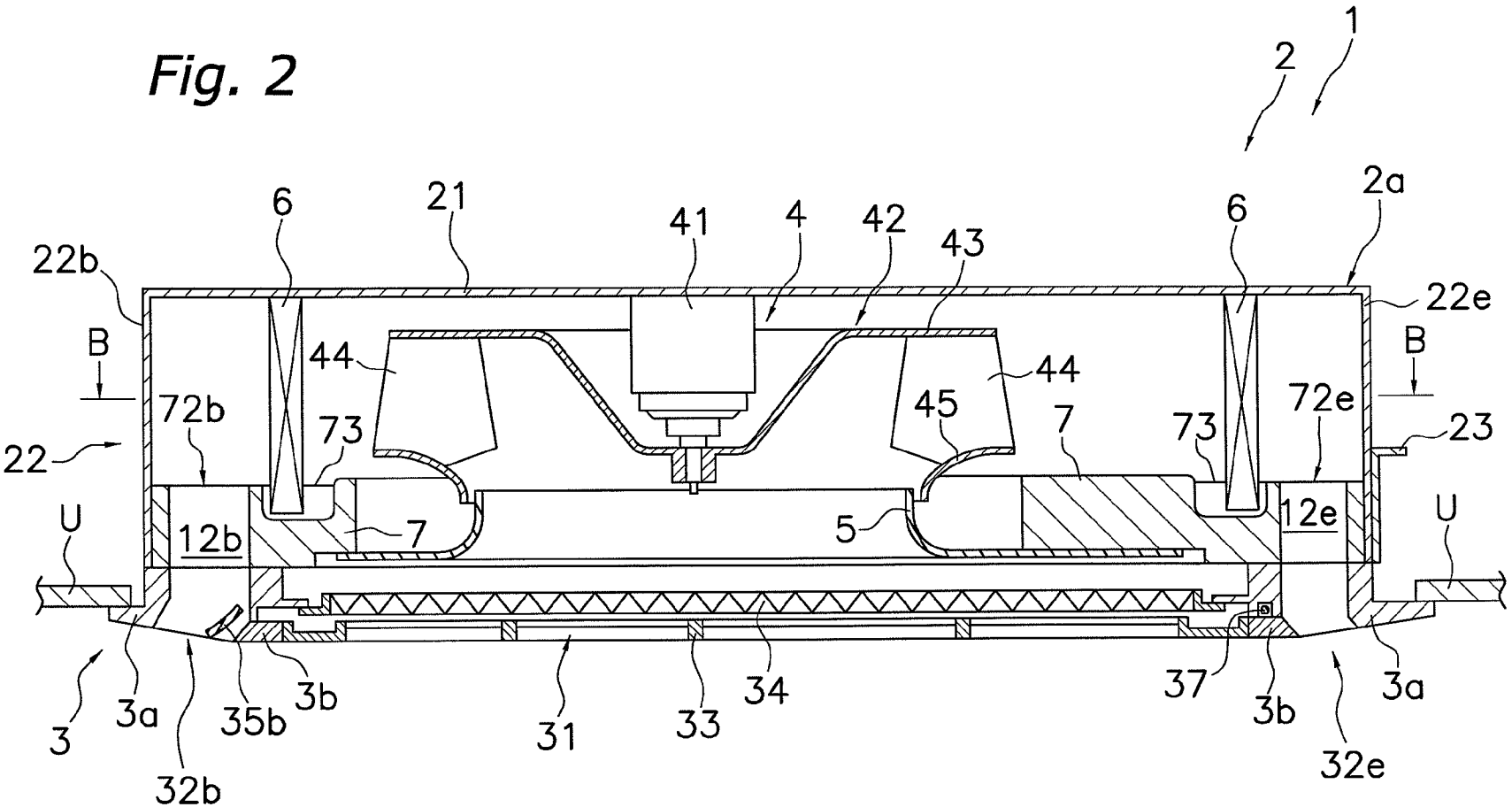
FIG. 2 is a schematic side cross sectional view of the air conditioner, and is a cross sectional view taken along the A-O-A line in FIG. 3.

FIG. 1 is an external perspective view of an air conditioner 1 according to one embodiment of the present invention (ceiling is not shown). The air conditioner 1 is a ceiling embedded type air conditioner, and comprises a casing 2 that internally houses various constituent equipment. The casing 2 comprises a casing main body 2*a*, and a face panel 3 disposed on the lower side of the casing main body 2*a*. As shown in FIG. 2, the casing main body 2*a* is disposed inserted into an opening formed in a ceiling U of the air conditioned room. Furthermore, the face panel 3 is disposed so that it is fitted into the opening of the ceiling U. Here, FIG. 2 is a schematic side cross sectional view of the air conditioner 1, and is a cross sectional view taken along the A-O-A line in FIG. 3.

<Casing Main Body>

Figure 3:
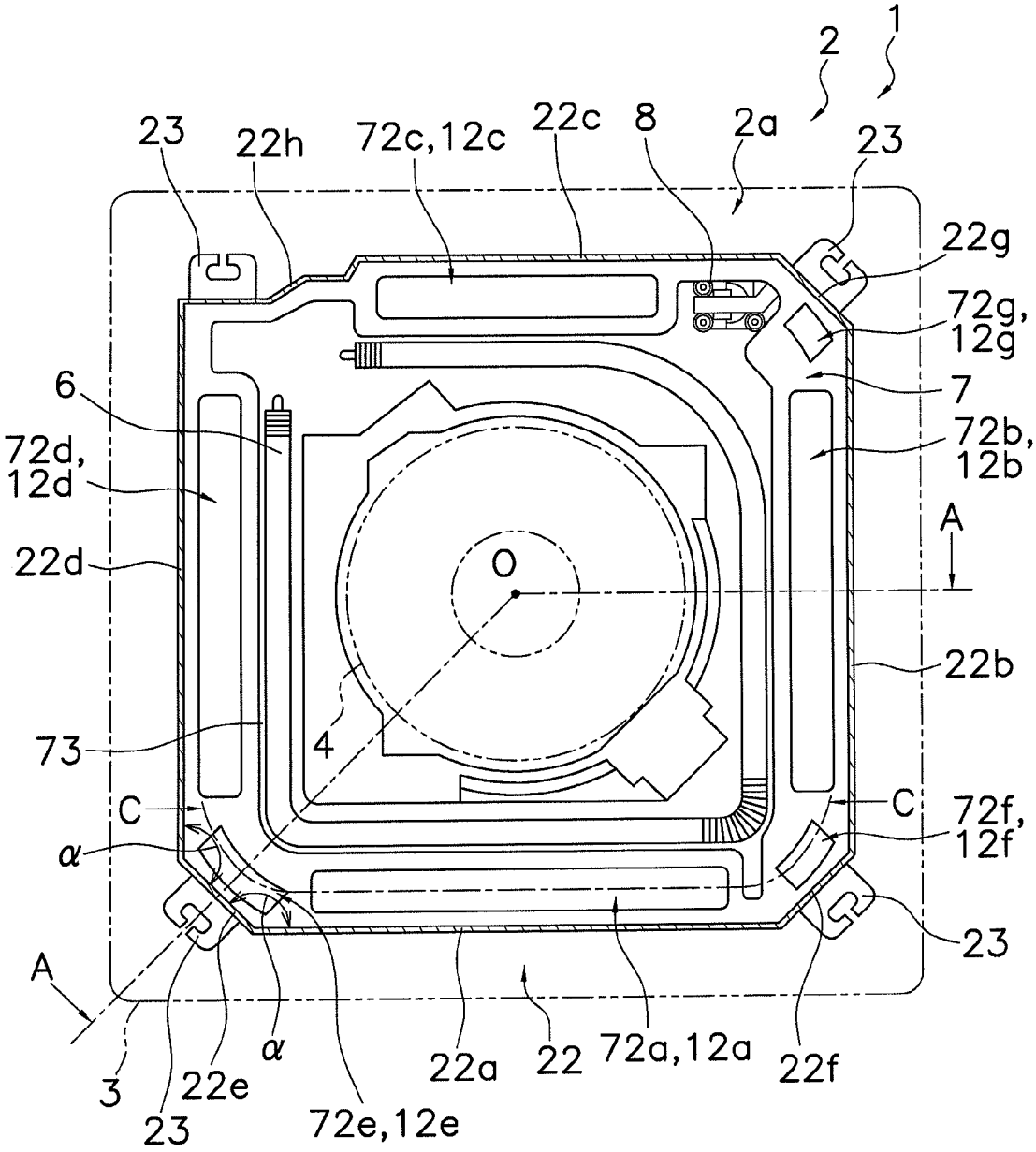
FIG. 3 is a schematic plan cross sectional view of the air conditioner, and is a cross sectional view taken along the B-B line in FIG. 2.

As shown in FIG. 2 and FIG. 3, the casing main body 2*a* is, in a plan view thereof, a box shaped body whose substantially octagonal lower surface is open and formed by alternating long sides and short sides, and comprising: a substantially octagonal top plate 21 formed by an alternating sequence of long sides and short sides; and a side plate 22 extending downward from a circumferential edge part of the top plate 21. Here, FIG. 3 is a schematic plan cross sectional view of the air conditioner 1, and is a cross sectional view taken along the B-B line in FIG. 2.

The side plate 22 comprises side plates 22*a*, 22*b*, 22*c*, 22*d* corresponding to the long sides of the top plate 21, and side plates 22*e*, 22*f*, 22*g*, 22*h* corresponding to the short sides of the top plate 21. Here, for example, the side plate 22*d* and the side plate 22*a* are disposed so that they are mutually substantially orthogonal with the side plate 22*e* interposed therebetween. The other side plates 22*a*, 22*b*, side plates 22*b*, 22*c*, and side plates 22*c*, 22*d* are likewise disposed so that they are mutually substantially orthogonal, the same as the side plates 22*d*, 22*a*. In addition, the side plate 22*e* is disposed so that an angle $\alpha$ formed between the adjoining side plate 22*d* and side plate 22*a* is approximately 135°. The side plates 22*f*, 22*g* are also disposed so that the angle formed between the adjoining side plates is approximately 135°, the same as the side plate 22*e*. Furthermore, the side plate 22*h* is shaped differently than the other side plates 22*e*, 22*f*, 22*g*, and comprises a portion wherethrough passes a refrigerant piping for exchanging refrigerants between a heat exchanger 6 (discussed later) and an outdoor unit (not shown). In addition, each of the side plates 22*e*, 22*f*, 22*g*, 22*h* is provided with a fixing bracket 23 used when installing the casing main body 2*a* in the space above the ceiling. Further, the lengths of the long sides and the short sides of the top plate 21 are set so that, in a plan view, the shape of the casing main body 2*a* including the fixing brackets 23 becomes substantially quadrilateral.

<Face Panel>

Figure 4:
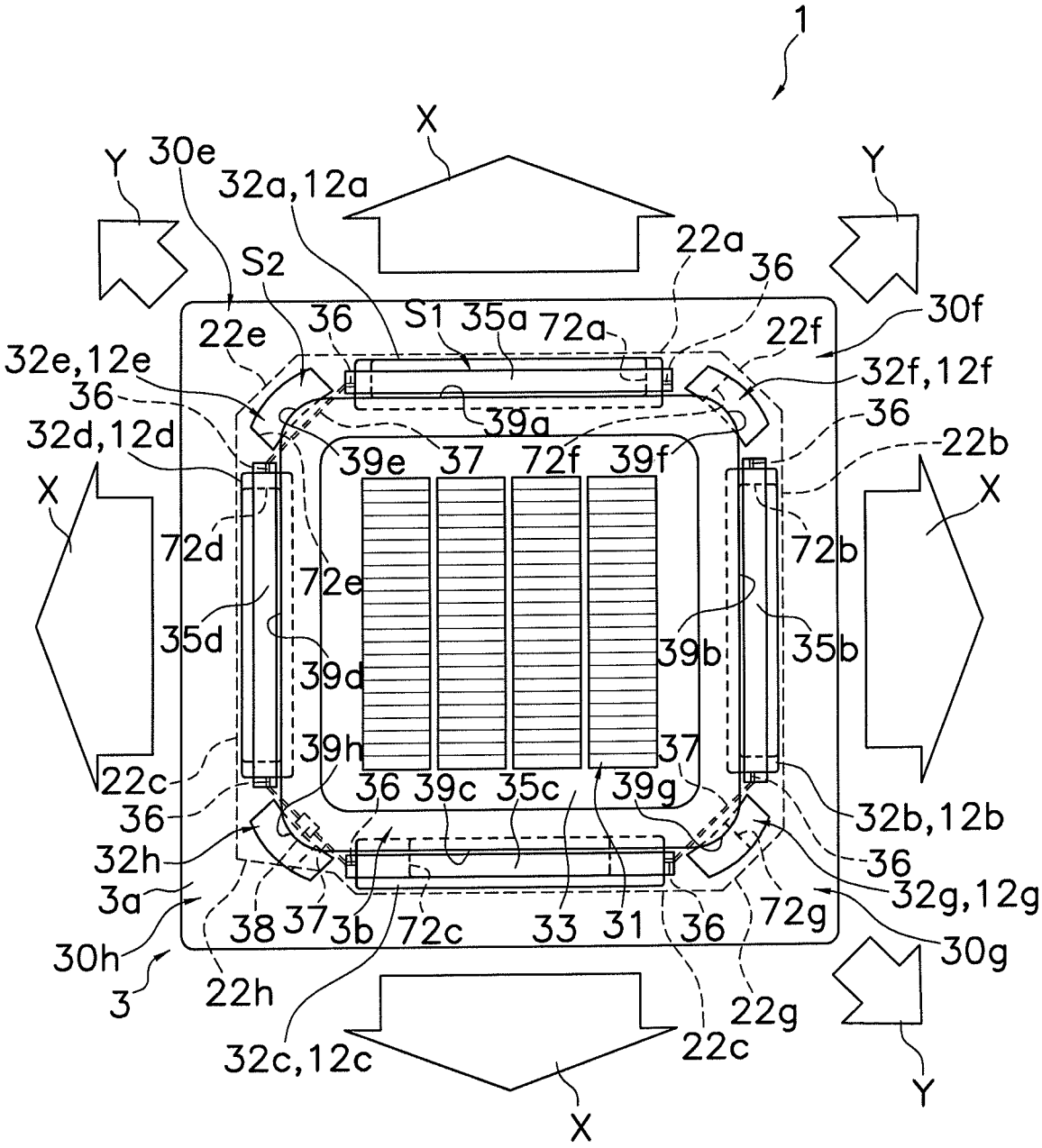
FIG. 4 is a plan view of a face panel of the air conditioner, viewed from inside the air conditioned room.

The face panel 3 is a substantially quadrilateral plate shaped body, in a plan view, as shown in FIG. 2, FIG. 3, and FIG. 4, and principally comprises a panel main body 3*a* fixed to a lower end part of the casing main body 2*a*. Here, FIG. 4 is a plan view of the face panel 3 of the air conditioner 1, viewed from inside the air conditioned room.

The panel main body 3*a* is formed by an alternating sequence of a plurality (four in the present embodiment) of panel side parts 30*a*, 30*b*, 30*c*, 30*d* (side parts) and a plurality (four in the present embodiment) of panel corner parts 30*e*, 30*f*, 30*g*, 30*h* (corner parts). The panel side parts 30*a*, 30*b*, 30*c*, 30*d* are disposed so that they correspond respectively to the side plates 22*a*, 22*b*, 22*c*, 22*d* of the casing main body 2*a*. The panel corner parts 30*e*, 30*f*, 30*g*, 30*h* are disposed so that they correspond respectively to the side plates 22*e*, 22*f*, 22*g*, 22*h* of the casing main body 2*a*.

The panel main body 3*a* comprises: an inlet 31 that, substantially at the center thereof, sucks in the air inside the air conditioned room, and a plurality (four in the present embodiment) of main outlets 32*a*, 32*b*, 32*c*, 32*d* formed corresponding respectively to the panel side parts 30*a*, 30*b*, 30*c*, 30*d* and that blow the air from inside the casing main body 2*a* out into the air conditioned room. The inlet 31 is a substantially square shaped opening in the present embodiment. The four main outlets 32*a*, 32*b*, 32*c*, 32*d* are substantially rectangular shaped openings that elongatingly extend so that they respectively run along the panel side parts 30*a*, 30*b*, 30*c*, 30*d*.

In addition, at the lower surface of the panel main body 3*a* is provided a square annular panel lower surface part 3*b* disposed so that it is surrounded by the inlet 31 and surrounds the four main outlets 32*a*, 32*b*, 32*c*, 32*d*. The panel lower surface part 3*b* comprises edge parts on the inlet 31 side of the main outlets 32*a*, 32*b*, 32*c*, 32*d*. Specifically, outer circumferential edge parts 39*a*, 39*b*, 39*c*, 39*d* corresponding to the four sides of the panel lower surface part 3*b* are disposed so that, in a plan view of the face panel 3, they overlap with portions of the main outlets 32*a*, 32*b*, 32*c*, 32*d* on the inlet 31 side.

Furthermore, an inlet grill 33, and a filter 34 for eliminating dust in the air sucked in from the inlet 31 are provided at the inlet 31.

In addition, horizontal flaps 35*a*, 35*b*, 35*c*, 35*d* (horizontal flaps) capable of oscillating about an axis in the longitudinal direction are respectively provided at the main outlets 32*a*, 32*b*, 32*c*, 32*d*. The horizontal flaps 35*a*, 35*b*, 35*c*, 35*d* are substantially rectangular shaped flap members elongatedly extending in the longitudinal direction of the respectively corresponding main outlets 32*a*, 32*b*, 32*c*, 32*d*, and linking pins 36 are respectively provided in the vicinity of both end parts in the longitudinal direction thereof. Furthermore, the horizontal flaps 35*a*, 35*b*, 35*c*, 35*d* are each rotatably supported to the face panel 3 by the linking pins 36, making them oscillatable about the axes of the main outlets 32*a*, 32*b*, 32*c*, 32*d* in the longitudinal direction. In the three panel corner parts 30*e*, 30*g*, 30*h*, excepting the panel corner part 30*f*, a linking shaft 37 serves as a link mechanism by mutually linking the adjoining linking pins 36. Taking the panel corner part 30*e* as an example, a linking shaft 37 links the linking pin 36 on the panel corner part 30*e* side of the horizontal flap 35*d* and the linking pin 36 on the panel corner part 30*e* side of the horizontal flap 35*a* so that they rotate by the rotation of the linking shaft 37. In addition, a drive shaft of a motor 38 is linked to the linking shaft 37 disposed in the panel corner part 30*h*. Thereby, driving the motor 38 synchronously oscillates the four horizontal flaps 35*a*, 35*b*, 35*c*, 35*d* vertically via the linking shafts 37, and via the linking pins 36 provided to the horizontal flaps 35*a*, 35*b*, 35*c*, 35*d*. Furthermore, oscillating these horizontal flaps 35*a*, 35*b*, 35*c*, 35*d* enables the wind direction of an air current X blown out from each of the main outlets 32*a*, 32*b*, 32*c*, 32*d* into the air conditioned room to be varied.

Figure 5:
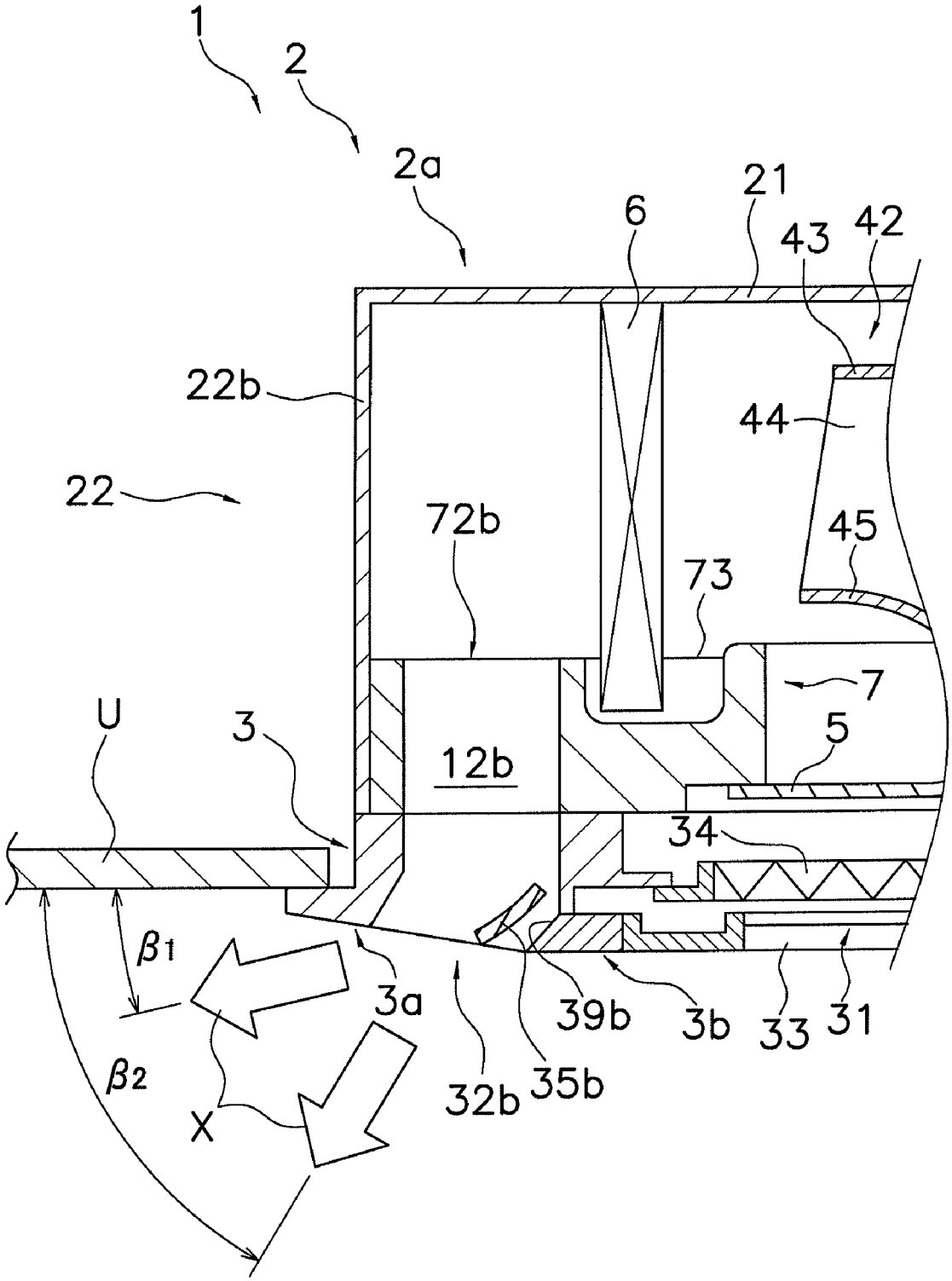
FIG. 5 is an enlarged view of FIG. 2, and depicts the vicinity of a main outlet passageway corresponding to a main outlet.

For example, as shown in FIG. 5, the wind direction of the air current X blown out from the main outlet 32*b* into the air conditioned room is varied in the vertical direction from an angle $\beta_1$ to an angle $\beta_2$ with respect to the lower surface of the ceiling U by the horizontal flap 35*b*. The wind direction of the air current blown out from each of the other main outlets 32*a*, 32*c*, 32*d* into the air conditioned room are likewise varied in the vertical direction from the angle $\beta_1$ to the angle $\beta_2$ with respect to the lower surface of the ceiling U, the same as the wind direction of the air current X blown out from the main outlet 32*b* into the air conditioned room. Here, FIG. 5 is an enlarged view of FIG. 2, and depicts the vicinity of a main outlet passageway 12*b* (discussed later) corresponding to the main outlet 32*b*.

Principally disposed inside the casing main body 2*a* are: a fan 4 that sucks the air inside the air conditioned room through the inlet 31 of the face panel 3 into the casing main body 2*a*, and blows the same out in the outer circumferential direction; and a heat exchanger 6 disposed so that it surrounds the outer circumference of the fan 4.

The fan 4 in the present embodiment is a turbofan, and comprises: a fan motor 41 provided in the center of the top plate 21 of the casing main body 2*a*; and an impeller 42 linked to and rotatably driven by the fan motor 41. The impeller 42 comprises: a disc shaped end plate 43 linked to the fan motor 41; a plurality of blades 44 provided at the outer circumferential part of the lower surface of the end plate 43; and a disc shaped end ring 45 provided on the lower side of the blade 44 and having an opening at the center. The fan 4 can suck in air through the opening of the end ring 45 to the interior of the impeller 42 by the rotation of the blades 44, and can blow out the air sucked into the impeller 42 to the outer circumferential side of the impeller 42.

In the present embodiment, the heat exchanger 6 is a cross finned tube type heat exchanger panel formed bent so that it surrounds the outer circumference of the fan 4, and is connected via the refrigerant piping to the outdoor unit (not shown) installed outdoors, and the like. The heat exchanger 6 can function as an evaporator of the refrigerant flowing internally during cooling operation, and as a condenser of the refrigerant flowing internally during heating operation. Thereby, the heat exchanger 6 exchanges heat with the air sucked in by the fan 4 through the inlet 31 into the casing main body 2*a*, and can cool the air during cooling operation and heat the air during heating operation.

A drain pan 7 is disposed on the lower side of the heat exchanger 6 for receiving drain water generated by the condensation of water in the air in the heat exchanger 6. The drain pan 7 is attached to the lower part of the casing main body 2*a*. The drain pan 7 comprises: an inlet hole 71 formed so that it communicates with the inlet 31 of the face panel 3; four main outlet holes 72*a*, 72*b*, 72*c*, 72*d* formed so that they communicate with the main outlets 32*a*, 32*b*, 32*c*, 32*d* of the face panel 3; and a drain water receiving groove 73 formed on the lower side of the heat exchanger 6 and that receives the drain water. Here, the main outlet holes 72*a*, 72*b*, 72*c*, 72*d* are shorter than the lengths of the respective corresponding main outlets 32*a*, 32*b*, 32*c*, 32*d* in the longitudinal direction. In particular, the main outlet hole 72*c* is shorter than the lengths of the other main outlet holes 72*a*, 72*b*, 72*d* in the longitudinal direction because it is interposed between: a drain pump 8 for discharging the drain water collected in the drain water receiving groove 73 disposed on the side plate 22*g* side; and the portion through which the refrigerant piping passes on the side plate 22*h* side.

Furthermore, with the inlet 31 of the face panel 3, the inlet hole 71 forms an inlet passageway that serves as the substantial inlet that sucks in the air inside the air conditioned room into the casing main body 2*a*. In addition, the main outlet holes 72*a*, 72*b*, 72*c*, 72*d* in conjunction with the main outlets 32*a*, 32*b*, 32*c*, 32*d* of the face panel 3, which communicate respectively therewith, form main outlet passageways 12*a*, 12*b*, 12*c*, 12*d* that serve as the substantial main outlets that blow out the air whose heat was exchanged in the heat exchanger 6 into the air conditioned room. In other words, with the air conditioner 1 of the present embodiment, the lower part of the casing 2 comprises the face panel 3 and the drain pan 7, and at the lower part of this casing 2 are formed the inlet passageway and main outlet passageways 12*a*, 12*b*, 12*c*, 12*d* that serve as the substantial inlet and main outlets.

In addition, a bell mouth 5 for guiding the air sucked in from the inlet 31 to the impeller 42 of the fan 4 is disposed in the inlet hole 71 of the drain pan 7.

(2) Auxiliary Outlet Structure, and Peripheral Configuration Thereof

Figure 6:
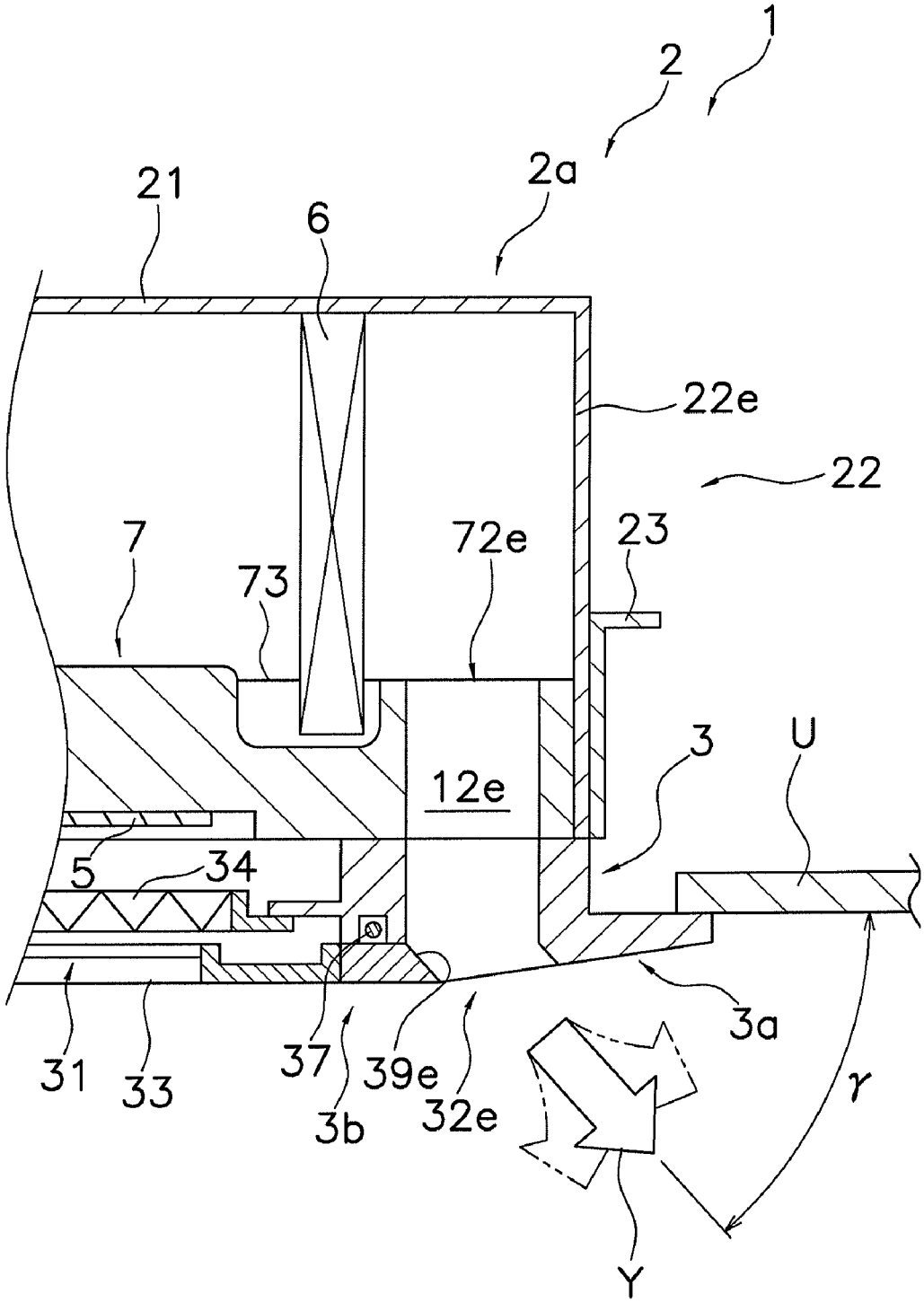
FIG. 6 is an enlarged view of FIG. 2, and depicts the vicinity of an auxiliary outlet passageway corresponding to an auxiliary outlet.
Figure 7:
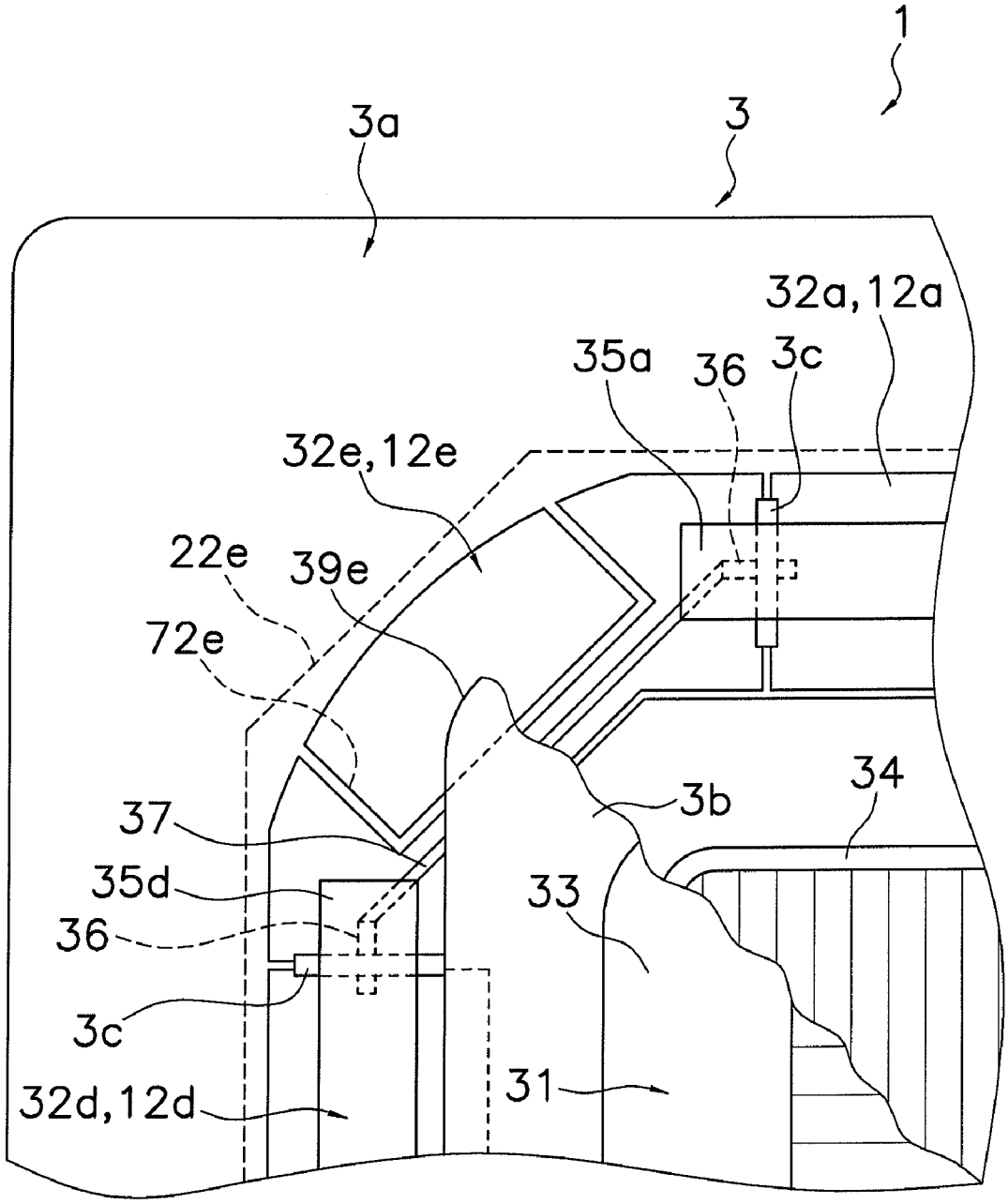
FIG. 7 is an enlarged view of FIG. 4, and depicts the vicinity of an auxiliary outlet (one part of a panel lower surface part is shown as a broken view).
Figure 8:
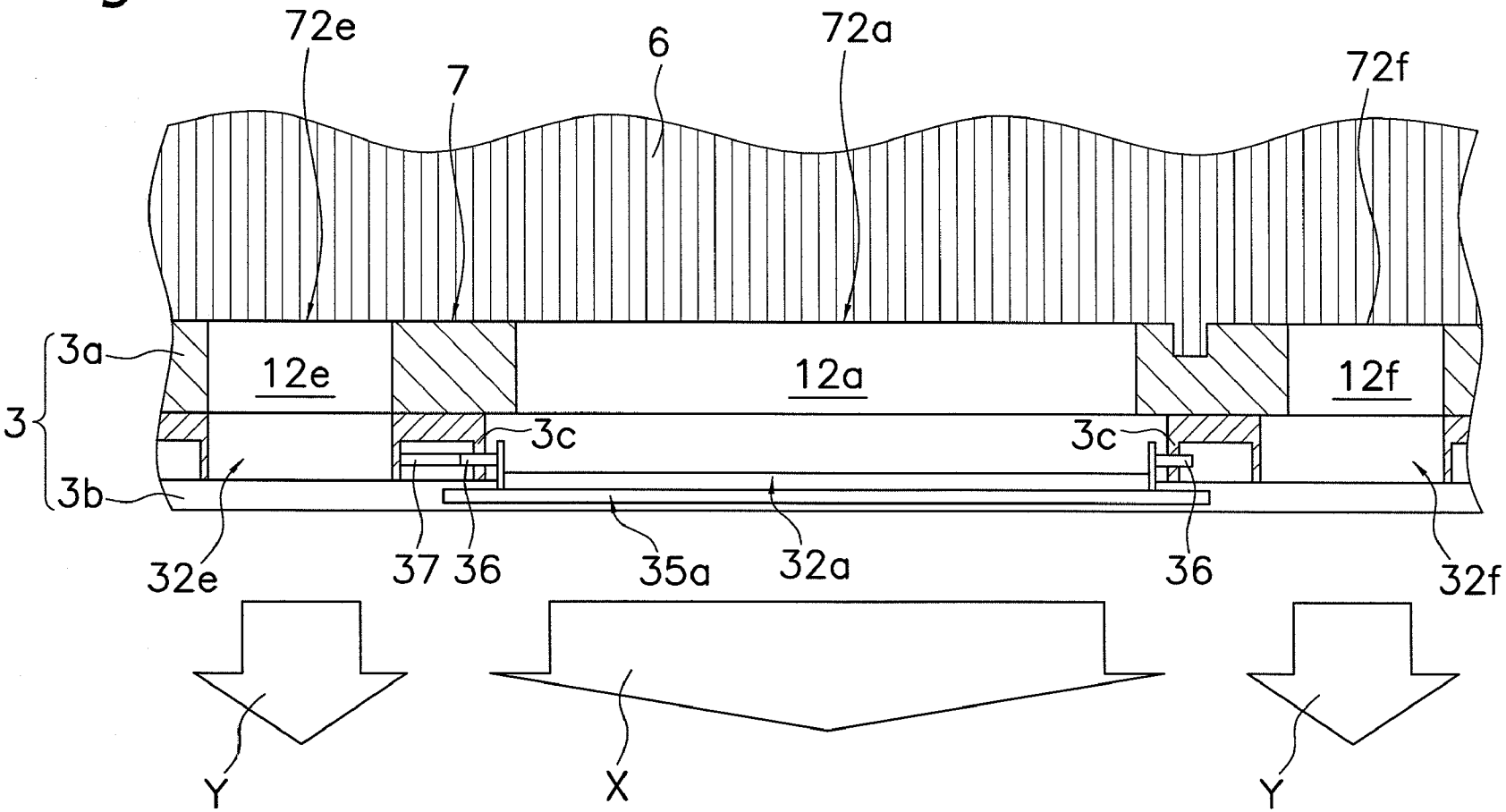
FIG. 8 is a cross sectional view taken along the C-C line in FIG. 3.

The air conditioner 1 having the basic constitution as described above further comprises a plurality (four in the present embodiment) of auxiliary outlets 32*e*, 32*f*, 32*g*, 32*h* formed so that they correspond respectively to the panel corner parts 30*e*, 30*f*, 30*g*, 30*h* of the face panel 3, and that blow the air from inside the casing main body 2*a* out into the air conditioned room, as shown in FIG. 1 through FIG. 8. Here, FIG. 6 is an enlarged view of FIG. 2, and depicts the vicinity of the auxiliary outlet passageway 12*e* (discussed later) corresponding to the auxiliary outlet 32*e*. FIG. 7 is an enlarged view of FIG. 4, and depicts the vicinity of the auxiliary outlet 32*e* (a broken view of one part of the panel lower surface part 3*b*). FIG. 8 is a cross sectional view taken along the C-C line in FIG. 3.

The four auxiliary outlets 32*e*, 32*f*, 32*g*, 32*h* are, in a plan view of the face panel 3, substantially rectangular shaped openings formed so that they respectively run along the side plates 22*e*, 22*f*, 22*g*, 22*h* of the casing main body 2*a*. Here, the opening area $S_2$ of each of the auxiliary outlets 32*e*, 32*f*, 32*g*, 32*h* is less than the opening area $S_1$ of each of the main outlets 32*a*, 32*b*, 32*c*, 32*d*.

In addition, the portions of the auxiliary outlets 32*e*, 32*f*, 32*g*, 32*h* on the inlet 31 side are disposed, in a plan view of the face panel 3, so that they overlap the outer circumferential corner parts 39*e*, 39*f*, 39*g*, 39*h* between the outer circumferential edge parts 39*a*, 39*b*, 39*c*, 39*d* of the panel lower surface part 3*b*. Consequently, the panel lower surface part 3*b* comprises not only the edge parts of the main outlets 32*a*, 32*b*, 32*c*, 32*d* on the inlet 31 side, but also the edge parts of the auxiliary outlets 32*e*, 32*f*, 32*g*, 32*h* on the inlet 31 side. Further, the surfaces on the auxiliary outlets 32*e*, 32*f*, 32*g*, 32*h* side of these outer circumferential corner parts 39*e*, 39*f*, 39*g*, 39*h* are formed so that the air blown out from each of the auxiliary outlets 32*e*, 32*f*, 32*g*, 32*h* into the air conditioned room is blown out in an inclined, downward, fixed direction.

Moreover, a horizontal flap for varying the wind direction of the blown-out air current is not provided at each of the auxiliary outlets 32*e*, 32*f*, 32*g*, 32*h*, unlike the main outlets 32*a*, 32*b*, 32*c*, 32*d*. Further, for example, as shown in FIG. 6, the wind direction of the air current blown out from the auxiliary outlet 32*e* into the air conditioned room is a direction formed by the angle $\gamma$ ($\fallingdotseq\beta_1/2+\beta_2/2$), which is the direction of substantially the middle of the range by which the horizontal flaps 35*d*, 35*a* provided at the adjoining main outlets 32*d*, 32*a* regulate in the vertical direction the wind direction of the air current blown out from each of the main outlets 32*d*, 32*a* (specifically, the range from the angle $\beta_1$ to the angle $\beta_2$ with respect to the lower surface of the ceiling U). The wind direction of the air current blown out from each of the other auxiliary outlets 32*f*, 32*g*, 32*h* into the air conditioned room are also the direction formed by the angle $\gamma$ with respect to the lower surface of the ceiling U, the same as the wind direction of the air current Y blown out from the auxiliary outlet 32*e* into the air conditioned room.

In addition, the drain pan 7 further comprises three auxiliary outlet holes 72*e*, 72*f*, 72*g* formed so that they communicate with the auxiliary outlets 32*e*, 32*f*, 32*g* of the face panel 3. Here, in the present embodiment, an auxiliary outlet hole is not formed at the position corresponding to the auxiliary outlet 32*h* of the face panel 3 of the drain pan 7. Consequently, in the present embodiment, the auxiliary outlet 32*h* of the face panel 3 does not have the function of blowing the air sucked into the casing main body 2*a* out toward the inside of the air conditioned room. Here, the auxiliary outlet hole 72*e* is substantially the same length as the corresponding auxiliary outlet 32*e* in the longitudinal direction, but the auxiliary outlet hole 72*f* is shorter than the length of the corresponding auxiliary outlet 32*f* in the longitudinal direction because one part of the drain water receiving groove 73 protrudes on the side plate 22*a* side. In addition, the auxiliary outlet hole 72*g* is shorter than the length of the corresponding auxiliary outlet 32*g* in the longitudinal direction because the drain pump 8 is disposed on the side plate 22*c* side.

Furthermore, the three auxiliary outlet holes 72*e*, 72*f*, 72*g* in conjunction with the auxiliary outlets 32*e*, 32*f*, 32*g* of the face panel 3, which communicates therewith, form three auxiliary outlet passageways 12*e*, 12*f*, 12*g* that blow the air whose heat was exchanged in the heat exchanger 6 out into the air conditioned room. In other words, with the air conditioner 1 of the present embodiment, the following are formed at the lower part of the casing 2 comprising the face panel 3 and the drain pan 7: the inlet passageway and the main outlet passageways 12*a*, 12*b*, 12*c*, 12*d* that serve as the substantial inlet and main outlets; and the auxiliary outlet passageways 12*e*, 12*f*, 12*g* that serve as the substantial auxiliary outlets.

In the present embodiment, linking shafts 37, for mutually connecting the linking pins 36 of the horizontal flaps 35*a*, 35*b*, 35*c*, 35*d* provided at the main outlets 32*a*, 32*b*, 32*c*, 32*d*, are disposed at the panel corner parts 30*e*, 30*f*, 30*h* wherein the auxiliary outlets 32*e*, 32*f*, 32*h* are provided. Taking the auxiliary outlet 32*e* as an example, the linking shaft 37 is disposed, in a plan view of the face panel 3, on the inlet 31 side of the auxiliary outlet 32*e*. Moreover, the linking pin 36 provided at the end part on the panel corner part 30*e* side of the horizontal flap 35*a* is provided at a position on the inner side of the end part of the horizontal flap 35*a* in the longitudinal direction and at a position on the upper side of the flap portion of the horizontal flap 35*a*, and is rotatably supported by the bearing part 3*c* of the panel main body 3*a*. Consequently, in a plan view of the face panel 3, the connection part between the linking shaft 37 and the linking pins 36, i.e., the linking shaft 37, is further constituted so that it is disposed on the inlet 31 side.

(3) Operation of the Air Conditioner

The following explains the operation of the air conditioner 1, referencing FIG. 2, FIG. 4, FIG. 5, and FIG. 6.

When operation starts, the fan motor 41 is driven, which rotates the impeller 42 of the fan 4. In addition, along with the driving of the fan motor 41, refrigerant is supplied from the outdoor unit (not shown) to the inside of the heat exchanger 6. Here, the heat exchanger 6 functions as an evaporator during cooling operation, and as a condenser during heating operation. Further, attendant with the rotation of the impeller 42, the air inside the air conditioned room is sucked from the inlet 31 of the face panel 3 through the filter 34 and the bell mouth 5 into the casing main body 2*a* from the lower side of the fan 4. This sucked in air is blown out to the outer circumferential side by the impeller 42, reaches the heat exchanger 6, is cooled or heated in the heat exchanger 6, and then blown through the main outlet holes 72*a*, 72*b*, 72*c*, 72*d* and the main outlets 32*a*, 32*b*, 32*c*, 32*d* (i.e., the main outlet passageways 12*a*, 12*b*, 12*c*, 12*d*), and the auxiliary outlet holes 72*e*, 72*f*, 72*g* and the auxiliary outlets 32*e*, 32*f*, 32*g* (i.e., the auxiliary outlet passageways 12*e*, 12*f*, 12*g*) out into the air conditioned room. In so doing, the inside of the air conditioned room is cooled or heated.

Here, the wind direction of the air current X blown from each of the main outlets 32*a*, 32*b*, 32*c*, 32*d* out into the air conditioned room is regulated by the horizontal flaps 35*a*, 35*b*, 35*c*, 35*d* to within the wind direction regulation range (specifically, the range from the angle $\beta_1$ to the angle $\beta_2$ with respect to the lower surface of the ceiling U). However, the air current Y blown from each of the auxiliary outlets 32*e*, 32*f*, 32*g* out into the air conditioned room is blown out in the direction of the angle $\gamma$, which is the direction of substantially the middle of the wind direction regulation range of the horizontal flaps 35*a*, 35*b*, 35*c*, 35*d* with respect to the lower surface of the ceiling U.

However, taking the auxiliary outlet 32*e* as an example, the auxiliary outlet 32*e* is disposed at the panel corner part 30*e* adjoining the main outlet 32*d* and the main outlet 32*a*, and is consequently easily affected by the air current X blown out from the main outlet 32*d* and the main outlet 32*a* into the air conditioned room. Specifically, the air current Y blown out from the auxiliary outlet 32*e* is dragged by the air current X blown out from the adjoining main outlet 32*d* and main outlet 32*a*, and its direction tends to vary. Consequently, the oscillation by the horizontal flaps 35*d*, 35*a* provided at the main outlets 32*d*, 32*a* changes the direction of the air current Y blown out from the auxiliary outlet 32*e* so that it proceeds in a direction the same as the wind direction of this air current X.

Thereby, if the wind direction of the air current X blown out from each of the main outlets 32*d*, 32*a* is regulated to an angle less than the wind direction of the air current Y (i.e., the direction of the angle $\gamma$ with respect to the lower surface of the ceiling U) blown out from the auxiliary outlet 32*e*, then the wind direction of the air current Y blown out from the auxiliary outlet 32*e* is dragged thereby, and becomes less than the angle $\gamma$. Conversely, if the wind direction of the air current X blown out from each of the main outlets 32*d*, 32*a* is regulated to an angle greater than the wind direction of the air current Y (i.e., the direction of the angle $\gamma$ with respect to the lower surface of the ceiling U) blown out from the auxiliary outlet 32*e*, then the wind direction of the air current Y blown out from the auxiliary outlet 32*e* is dragged thereto, and becomes greater than the angle $\gamma$.

Thus, the wind direction of the air current Y blown out from the auxiliary outlet 32*e* can be varied even if blown out in a fixed direction, without providing a mechanism, such as the horizontal flaps, for varying in the vertical direction the wind direction of the air blown out from the auxiliary outlet 32*e*. Furthermore, the blow-out direction of the air current Y for each of the other auxiliary outlets 32*f*, 32*g* can also be varied in accordance with changes in the wind direction of the air current X blown out from each of the contiguous main outlets, without providing a mechanism, such as the horizontal flaps, the same as the auxiliary outlet 32*e*.

In addition, the opening area $S_2$ of each of the auxiliary outlets 32*e*, 32*f*, 32*g* is less than the opening area $S_1$ of each of the main outlets 32*a*, 32*b*, 32*c*, 32*d*, which significantly does not decrease the flow speed of the air blown out from each of the main outlets 32*a*, 32*b*, 32*c*, 32*d*; consequently, providing the auxiliary outlets 32*e*, 32*f*, 32*g* enables the satisfactory air current distribution inside the air conditioned room, as well as enables the air blown out from each of the main outlets 32*a*, 32*b*, 32*c*, 32*d* to reach as far as possible.

(4) Characteristics of the Air Conditioner

The air conditioner 1 of the present embodiment has the following characteristics.

(A)

With the air conditioner 1 of the present embodiment, the provision of the horizontal flaps 35*a*, 35*b*, 35*c*, 35*d*, which are oscillatable about the axes of the main outlets 32*a*, 32*b*, 32*c*, 32*d* in the longitudinal direction, enables the variation of the wind direction of the air current X blown out from each of the main outlets 32*a*, 32*b*, 32*c*, 32*d*; however, the circumferential edge part of each of the auxiliary outlets 32*e*, 32*f*, 32*g*, 32*h* (in the present embodiment, the surfaces on the auxiliary outlets 32*e*, 32*f*, 32*g*, 32*h* side of the outer circumferential corner parts 39*e*, 39*f*, 39*g*, 39*h* of the panel lower surface part 3*b*) is only constituted so that the air current Y blown out from each of the auxiliary outlets 32*e*, 32*f*, 32*g* is blown out in a fixed direction, and the auxiliary outlets 32*e*, 32*f*, 32*g*, 32*h* are not provided with mechanisms, such as the horizontal flaps.

Even with such a constitution, the flow volume of the air blown out into the air conditioned room by the provision of the auxiliary outlets 32*e*, 32*f*, 32*g* can be increased, the air current distribution inside the air conditioned room can be made satisfactory, and the constitution for regulating the blow-out direction can be simplified because: the direction of the air current Y blown out from each of the auxiliary outlets 32*e*, 32*f*, 32*g* can be varied by taking advantage of the characteristic wherein the air current Y blown out from each of the auxiliary outlets 32*e*, 32*f*, 32*g* is dragged by the air current X blown out from each of the adjoining main outlets 32*a*, 32*b*, 32*c*, 32*d*, thereby changing the blow-out direction without providing a mechanism, such as the horizontal flaps, for varying the wind direction in the vertical direction of the air current Y blown out from each of the auxiliary outlets 32*e*, 32*f*, 32*g*.

Moreover, because the vertical blow-out direction of the air current Y blown out from each of the auxiliary outlets 32*e*, 32*f*, 32*g* is the direction of substantially the middle of the range by which the horizontal flaps 35*a*, 35*b*, 35*c*, 35*d* vertically regulate the wind direction of the blow-out direction of the air current X blown out from each of the main outlets 32*a*, 32*b*, 32*c*, 32*d*, the air current Y blown out from each of the auxiliary outlets 32*e*, 32*f*, 32*g* is blown out in a direction close to the blow-out direction of the air current X blown out from each of the main outlets 32*a*, 32*b*, 32*c*, 32*d*, and is thus easily affected by the air current X blown out from each of the main outlets 32*a*, 32*b*, 32*c*, 32*d*. Thereby, the tracking characteristics improve when changing the wind direction of the air current Y dragged by the air current X blown out from each of the main outlets 32*a*, 32*b*, 32*c*, 32*d* and blown out from each of the auxiliary outlets 32*e*, 32*f*, 32*g*, and the air current distribution inside the air conditioned room can thereby be more satisfactorily maintained.

In addition, because the opening area $S_2$ of each of the auxiliary outlets 32*e*, 32*f*, 32*g*, 32*h* is less than the opening area $S_1$ of each of the main outlets 32*a*, 32*b*, 32*c*, 32*d*, the flow speed of the air current blown out from each of the main outlets 32*a*, 32*b*, 32*c*, 32*d* does not decrease significantly, and the provision of the auxiliary outlets 32*e*, 32*f*, 32*g* thereby enables the satisfactory air current distribution inside the air conditioned room, and enables the air current X blown out from each of the main outlets 32*a*, 32*b*, 32*c*, 32*d* to reach as far as possible.

(B)

With the air conditioner 1 of the present embodiment, by disposing the linking shafts 37, which serve as link mechanisms for mutually and synchronously oscillating the horizontal flaps 35*a*, 35*b*, 35*c*, 35*d* provided at the main outlets 32*a*, 32*b*, 32*c*, 32*d*, on the inlet 31 side of the auxiliary outlets 32*e*, 32*f*, 32*h*, it is possible to provide both the auxiliary outlets 32*e*, 32*f*, 32*g*, 32*h* and the linking shafts 37 at the panel corner parts 30*e*, 30*f*, 30*g*, 30*h*, without having to make modifications, such as increasing the plan shape of the casing main body 2*a* (specifically, the top plate 21).

For example, with the air conditioner 1 of the present embodiment, the long sides and the short sides of the top plate 21 are set so that the plan shape of the casing main body 2*a*, including the fixing brackets 23, is substantially a quadrilateral shape, but this dimensional relationship does not need to be modified.

Moreover, the horizontal flaps 35*a*, 35*b*, 35*c*, 35*d* comprise the linking pins 36 linked to the linking shafts 37 at a position in the longitudinal direction on the inner side of the end part in the longitudinal direction thereof, and the linking shafts 37 can consequently be further disposed on the inlet 31 side of the auxiliary outlets 32*e*, 32*f*, 32*h*, thus enabling the auxiliary outlets 32*e*, 32*f*, 32*g*, 32*h* to be easily formed at the panel corner parts 30*e*, 30*f*, 30*g*, 30*h*.

(5) Other Embodiments

The above explained an embodiment of the present invention based on the drawings, but the specific constitution is not limited to these embodiments, and it is understood that variations and modifications may be effected without departing from the spirit and scope of the invention.

(A)

Figure 9:
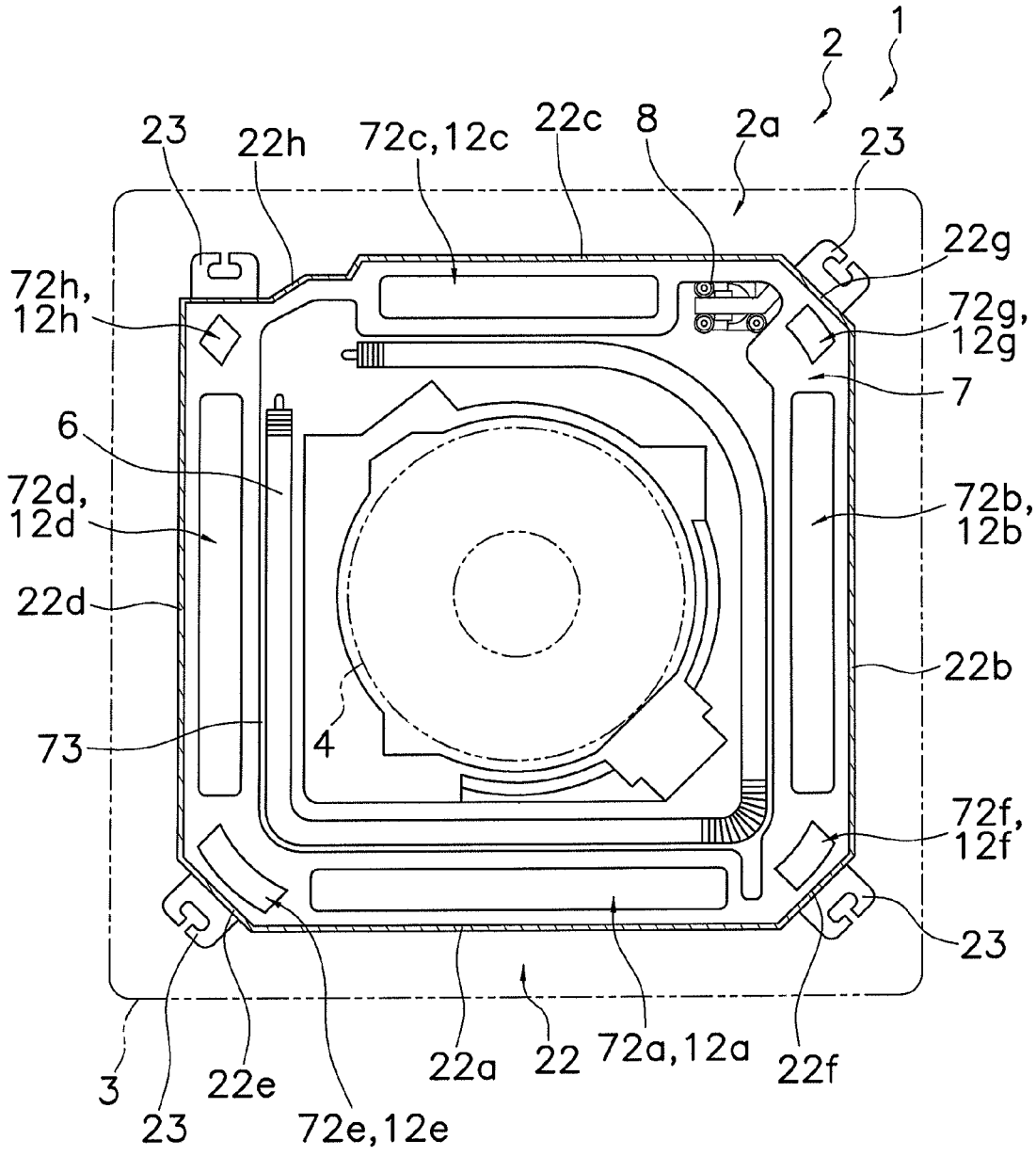
FIG. 9 is a schematic plan cross sectional view of the air conditioner according to another embodiment, and is a view that corresponds to FIG. 3.

In the abovementioned embodiment, although the auxiliary outlets 32*e*, 32*f*, 32*g*, 32*h* are formed so that they correspond to all of the panel corner parts 30*e*, 30*f*, 30*g*, 30*h*, an auxiliary outlet hole corresponding to the auxiliary outlet 32*h* is not provided in the drain pan 7; consequently, of the four auxiliary outlets 32*e*, 32*f*, 32*g*, 32*h*, only the three auxiliary outlets 32*e*, 32*f*, 32*g* function as substantial auxiliary outlets, however, the air inside the casing main body 2*a* may be blown out from the auxiliary outlet 32*h* into the air conditioned room by forming the auxiliary outlet hole 72*h* also at a position corresponding to the auxiliary outlet 32*h* of the drain pan 7, and by providing the auxiliary outlet passageway 12*h*, as shown in FIG. 9 (a schematic plan cross sectional view of the air conditioner according to another embodiment, and a view equivalent to FIG. 3). Thereby, the air can be blown from all four panel side parts 30*a*, 30*b*, 30*c*, 30*d* and all four panel corner parts 30*e*, 30*f*, 30*g*, 30*h* of the face panel 3 out into the air conditioned room, and the distribution of the air blown out into the air conditioned room can be made further satisfactory.

(B)

In the abovementioned embodiments, the auxiliary outlets 32*e*, 32*f*, 32*g*, 32*h* are formed at all panel corner parts 30*e*, 30*f*, 30*g*, 30*h*, but is preferably formed in a state wherein the air inside the casing main body 2*a* can be blown out to at least one of the panel corner parts 30*e*, 30*f*, 30*g*, 30*h* (i.e., in a state wherein the auxiliary outlet holes are formed in the drain pan 7). Even in this case, the wind direction of the air blown out from each of the auxiliary outlets can be varied without providing mechanisms, such as the horizontal flaps, for varying in the vertical direction the wind direction of the air blown out from the auxiliary outlets; consequently, the air current distribution inside the air conditioned room can be made satisfactory, and the structure for regulating the blow-out direction can be simplified.

(C)

In the abovementioned embodiments, the present invention was applied to a ceiling embedded type air conditioner, but is also applicable to a ceiling suspended type air conditioner.

INDUSTRIAL FIELD OF APPLICATION

The use of the present invention enables, in an air conditioner provided in the ceiling of an air conditioned room, the satisfactory air current distribution inside the air conditioned room, and the simplification of the structure for regulating the wind direction of the air currents blown out from each of the outlets.

What is claimed is:

1. An air conditioner provided in a ceiling of an air conditioned room, comprising:

a face panel including a panel main body including an alternating sequence of four side parts and four corner parts, main outlets disposed along each of the side parts, an inlet surrounded by all of the side parts, auxiliary outlets disposed at at least one of the four corner parts, and a panel lower surface part disposed on a lower surface of the panel main body such that the panel lower surface part surrounds the inlet and is surrounded by the auxiliary outlets disposed at at least one of the four corner parts;

a box shaped casing main body having an open lower end, a drain pan attached to the lower end of the casing main body, the drain pan including an inlet hole arranged to communicate with the inlet of the face panel, main outlet holes arranged to communicate with the main outlets of the face panel, and auxiliary outlet holes arranged to communicate with the auxiliary outlets of the face panel, and horizontal flaps rotatably supported about longitudinal axes of the main outlets and configured to vary a wind direction of an air current blown out from each of the main outlets, the panel lower surface part having outer circumferential edge parts that are arranged to overlap with inlet side portions of the main outlets and the auxiliary outlets as viewed in a direction parallel to an airflow direction of airflow through the inlet hole, the outer circumferential edge parts overlapping with inlet side portions of the main outlets and the auxiliary outlets such that the outer circumferential edge parts define inner peripheral edges of the main outlets and the auxiliary outlets, each of the auxiliary outlets having a circumferential edge part formed so that air is blown out from each of the auxiliary outlets in a fixed direction.

2. The air conditioner as recited in claim 1, wherein each of the auxiliary outlets has an opening area that is smaller than an opening area of each of said main outlet.

3. The air conditioner as recited in claim 1, wherein each of the outer circumferential edge parts of the panel lower surface part has an inner air guide surface that is inclined relative to the direction parallel to the airflow direction of airflow through the inlet hole.

4. The air conditioner as recited in claim 3, wherein the panel main body has a plurality of inclined outer air guide surfaces that are substantially parallel to the inner air guide surfaces of the panel lower surface part, the outer air guide surfaces of the panel main body defining outer peripheral edges of the main outlets and the auxiliary outlets.

5. The air conditioner as recited in claim 4, wherein the horizontal flaps are located closer to the inner peripheral edges of the main outlets than to the outer peripheral edges of the main outlets.

6. The air conditioner as recited in claim 1, wherein the panel main body has a plurality of outer air guide surfaces that are inclined relative to the direction parallel to the airflow direction of airflow through the inlet hole, the outer air guide surfaces of the panel main body defining outer peripheral edges of the main outlets and the auxiliary outlets.

7. The air conditioner as recited in claim 1, wherein the horizontal flaps are located closer to the inner peripheral edges of the main outlets than to outer peripheral edges of the main outlets.

8. The air conditioner as recited in claim 1, wherein each of the auxiliary outlet holes has a longitudinal length that is substantially the same as or shorter than a longitudinal length of a corresponding one of the auxiliary outlets of the face panel.

9. The air conditioner as recited in claim 8, wherein the longitudinal length of at least one of the auxiliary outlet holes is shorter than the longitudinal length of the corresponding one of the auxiliary outlets of the face panel.

10. An air conditioner provided in a ceiling of an air conditioned room, comprising:

a face panel including a panel main body formed by an alternating sequence of four side parts and four corner parts, main outlets disposed along each of the side parts, an inlet surrounded by all of the side parts, auxiliary outlets disposed at at least one of the four corner parts, and a panel lower surface part disposed on a lower surface of the panel main body such that the panel lower surface part surrounds the inlet and is surrounded by the auxiliary outlets disposed at at least one of the four corner parts;

a box shaped casing main body having an open lower end, a drain pan attached to the lower end of the casing main body, the drain pan including:

an inlet hole arranged to communicate with the inlet of the face panel, main outlet holes arranged to communicate with the main outlets of the face panel, and auxiliary outlet holes arranged to communicate with the auxiliary outlets of the face panel, and horizontal flaps rotatably supported about longitudinal axes of the main outlets and configured to vary a wind direction of an air current blown out from each of the main outlets, each of the auxiliary outlet holes has a longitudinal length that is substantially the same as or shorter than a longitudinal length of a corresponding one of the auxiliary outlets of the face panel, each of the auxiliary outlets having a circumferential edge part formed so that air is blown out from each of the auxiliary outlets in a fixed direction.

11. The air conditioner as recited in claim 10, wherein the longitudinal length of at least one of the auxiliary outlet holes is shorter than the longitudinal length of the corresponding one of the auxiliary outlets of the face panel.

12. The air conditioner as recited in claim 10, wherein each of the auxiliary outlets has an opening area that is smaller than an opening area of each of said main outlet.

13. The air conditioner as recited in claim 10, wherein the panel lower surface part having outer circumferential edge parts that define inner peripheral edges of the main outlets and the auxiliary outlets.

14. The air conditioner as recited in claim 13, wherein each of the outer circumferential edge parts of the panel lower surface part has an inner air guide surface that is inclined relative to a direction parallel to an airflow direction of airflow through the inlet hole.

15. The air conditioner as recited in claim 14, wherein the panel main body has a plurality of outer air guide surfaces that are substantially parallel to the inner air guide surfaces of the panel lower surface part, the outer air guide surfaces of the panel main body defining outer peripheral edges of the main outlets and the auxiliary outlets.

16. The air conditioner as recited in claim 15, wherein the horizontal flaps are located closer to the inner peripheral edges of the main outlets than to the outer peripheral edges of the main outlets.

17. The air conditioner as recited in claim 10, wherein the panel main body has a plurality of outer air guide surfaces that are inclined relative to a direction parallel to an airflow direction of airflow through the inlet hole, the outer air guide surfaces of the panel main body defining outer peripheral edges of the main outlets and the auxiliary outlets.

18. The air conditioner as recited in claim 10, wherein the horizontal flaps are located closer to inner peripheral edges of the main outlets than to outer peripheral edges of the main outlets.

* * * * *